United States Patent [19]

Glaeser et al.

[11] Patent Number: 4,802,312

[45] Date of Patent: Feb. 7, 1989

[54] WET SAND BLASTING WITH PRESSURIZED WATER FEED

[75] Inventors: Karl C. Glaeser; Gerhard Buhr, both of Leverkusen, Fed. Rep. of Germany

[73] Assignee: Ernst Peiniger GmbH Unternehmen für Bautenschutz, Essen, Fed. Rep. of Germany

[21] Appl. No.: 395,619

[22] Filed: Jul. 6, 1982

[30] Foreign Application Priority Data

Jul. 9, 1981 [DE] Fed. Rep. of Germany ..... 3127035

[51] Int. Cl.[4] ..... B24C 1/00

[52] U.S. Cl. ..... 51/321; 51/319; 51/439; 51/410

[58] Field of Search ..... 51/410, 439, 319, 320, 51/321, 428

[56] References Cited

U.S. PATENT DOCUMENTS

| | | | |
|---|---|---|---|
| 738,218 | 2/1905 | Murray | 51/439 X |
| 1,848,122 | 3/1932 | Forster | 51/439 X |
| 2,369,576 | 2/1945 | Keefer | 51/439 |
| 2,380,738 | 7/1945 | Eppler | 51/321 |
| 2,508,766 | 5/1950 | Morel | 51/319 |
| 2,543,517 | 2/1951 | Anderson | 51/439 X |
| 4,080,762 | 3/1978 | Watson | 51/439 |
| 4,253,610 | 3/1981 | Larkin | 51/439 X |

FOREIGN PATENT DOCUMENTS

| | | | |
|---|---|---|---|
| 0192600 | 11/1907 | Fed. Rep. of Germany | 51/439 |
| 2911629 | 9/1980 | Fed. Rep. of Germany | 51/439 |
| 0221534 | 10/1968 | U.S.S.R. | 51/439 |

*Primary Examiner*—Frederick R. Schmidt
*Assistant Examiner*—Robert A. Rose

[57] ABSTRACT

For sand blasting a stream of a suspension of a carrier gas and solid particles under superatmospheric pressure is restricted so that it is accelerated, and a liquid-carrying additive gas is mixed with the stream to moisten the particles. The additive gas is introduced into the stream at a pressure greater than the pressure of the stream at the location by between 1.5 and 2.5 times. Normally the additive-gas pressure is about twice the carrier-gas pressure, that is the additive gas is normally introduced at a pressure of between about 10 bar and 30 bar. This high-pressure introduction ensures that the additive gas enters well into the carrier-gas stream so that the liquid carried by the additive gas contacts and wets the solids carried by the carrier gas without just passing through it and wetting the inside of the sand-blast mix nozzle. The additive gas is introduced into the stream in a unit of time at a rate sufficient to introduce into the stream a quantity of the liquid equal to between about one-twentieth to one-thirtieth, preferably one-twenty-fifth, the mass of the particles passing the location during the unit of time.

7 Claims, 1 Drawing Sheet

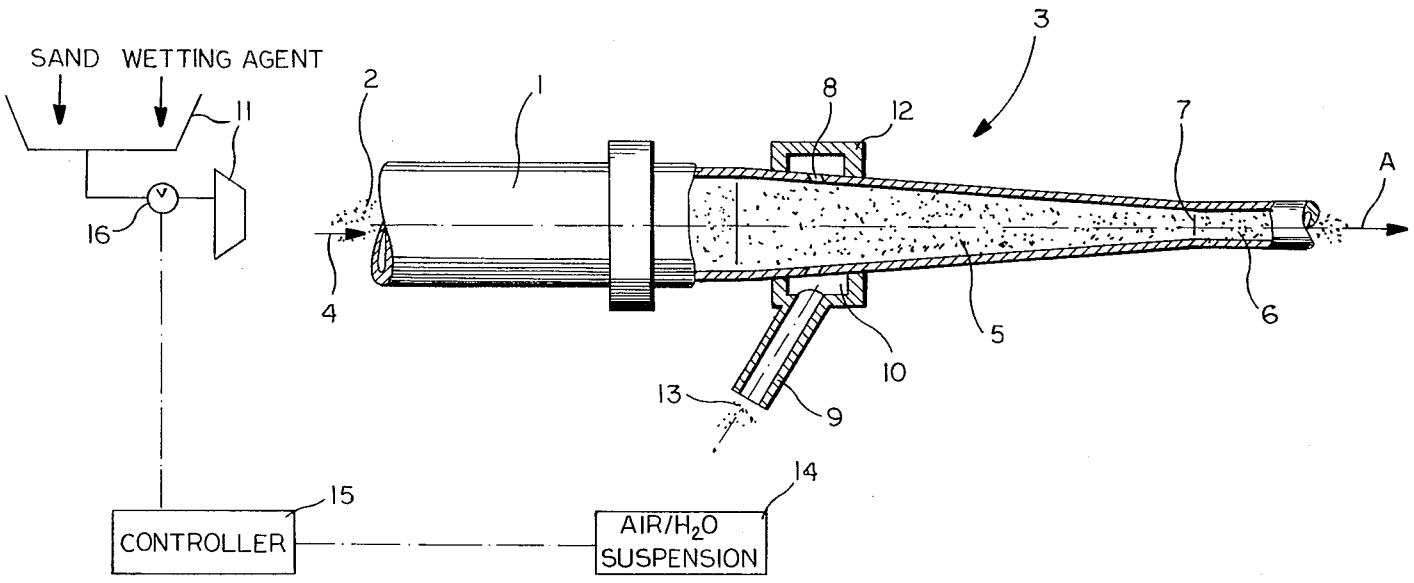
A
6
7
3
5
12
10
8
9
14
13
AIR/$H_2O$ SUSPENSION
1
2
4
15
SAND
WETTING AGENT
11
16
CONTROLLER

WET SAND BLASTING WITH PRESSURIZED WATER FEED

FIELD OF THE INVENTION

The present invention relates to a method of and apparatus for sand blasting, that is treating a surface by projecting hard particles against it in a high-pressure gas stream. More particularly this invention concerns such a method wherein water is added to the stream to moisten these particles.

BACKGROUND OF THE INVENTION

Standard sand blasting is a procedure whereby hard particulate matter, typically fine sand, is suspended in a stream of air which is directed against a surface to be eroded by the sand. The stream moves along a hose to a nozzle provided at its outlet end with a restriction that raises the speed of the stream while lowering its static pressure. Thus the rapidly moving sand can hit the surface being treated with considerable force so such a procedure can remove rust, paint, and similar abradable substances.

In the standard system, dry sand blasting, essentially moisture-free sand and air only are used. Wet sand cannot be used because it cannot be entrained properly by the air stream, but instead will clump and clog the equipment. The problem with this system is that it generates a great deal of dust. Not only is the sand in the stream quite dusty, but it raises a great deal of dust in the form of the material abraded from the surface being sand blasted. In fact it is necessary to provide the operators of such equipment with respirators so they do not breath this dust, and it is necessary to enclose the environs of the job, which can be quite difficult for instance when a building exterior is being sand blasted from scaffolding.

Hence the technique of wet sand blasting as described in German patent No. 2,724,318 has been developed. In the standard form an aspiration line provided with a valve has one end in a water reservoir and another end opening into the nozzle of the machine right at the restriction of its outlet end. The low static pressure at the restriction sucks the water out of the reservoir like in a paint sprayer. This water moistens the sand so that it does not generate dust itself, and it in turn moistens the particles it knocks loose to prevent them from becoming airborne.

It is, however, fairly difficult to adjust the feed rate for the water or water/air suspension with such a system. If the mixture is too lean, that is with too little water, the outer particles in the spray wil be adequately wetted but the inner ones will not. If adjusted to wet these inner particles in the jet, so much water is projected against the surface that it creates runoff which is normally not permissible. This adjustment problem is present no matter where the water is introduced into the stream.

OBJECTS OF THE INVENTION

It is therefore an object of the present invention to provide an improved method of sand blasting.

Another object is the provision of such a method of sand blasting which overcomes the above-given disadvantages.

Thus it is an object of the invention to provide a wet sand blasting method wherein each particle in the sand-blast jet is coated with water, but the water added to the jet is not so much that it runs off the surface being sand blasted.

Yet another object is to provide an improved apparatus for carrying out the method of this invention.

SUMMARY OF THE INVENTION

These objects are attained according to the instant invention in a method of sand blasting of the above described general type, that is wherein a stream of a suspension of a carrier gas and solid particles under superatmospheric pressure is restricted so that it is accelerated, and a liquid-carrying additive gas is mixed with the stream to moisten the particles. According to this invention, the additive gas is introduced into the stream at a pressure greater than the pressure of the stream at the mixing location by between 1.5 and 2.5 times.

Normally according to this invention the additive-gas pressure is about twice the carrier-gas pressure, that is the additive gas is normally introduced at a pressure of between about 10 bar and 30 bar. This high-pressure introduction ensures that the additive gas enters well into the carrier-gas stream so that the liquid carried by the additive gas contacts and wets the solids carried by the carrier gas without just passing through it and wetting the inside of the sand-blast mix nozzle.

Bernoulli's Law describes the overall pressure of a flowing medium as being made up by its static and dynamic pressure. The dynamic pressure is the main factor determining the kinetic energy of the medium, and is normally directly related to the speed of the medium. The relationship of dynamic pressure, which are those pressures meant in the ratio of the instant invention, has been found to give excellent results. Thus it would virtually be possible to say that the instant invention lies in introducing into the particle-carrying carrier-gas stream a liquid-carrying additive-gas stream moving at about twice the speed of the carrier-gas stream.

According to another feature of this invention the additive gas is introduced into the stream in a unit of time at a rate sufficient to introduce into the stream a quantity of the liquid equal to between about one-twentieth to one-thirtieth, preferably one-twenty-fifth, the mass of the particles passing the location during the unit of time. Introducing water at this rate relative to the solid phase ensures excellent coating of each particle with the liquid, without introducing so much liquid that it will run off the surface being sand blasted. Normally the liquid, as mentioned above, is just water.

In accordance with another feature of this invention in a unit of time the mass of the particles of the carrier-gas stream passing the mixing location is equal to between about 1.4 to 2.5 times, preferably between 1.7 and 2.2 times, the mass of the carrier-gas stream itself passing the location during the unit of time. This ratio ensures that the additive-gas stream will not deflect the carrier-gas stream.

For most effective wetting of the particles in the carrier-gas stream, the invention provides for coating of the particles with a hydrophilic agent before suspending them in this stream. According to this invention a surfactant such as tergitol (2-ethylhexanol sulfite) is mixed with the particles before they are themselves mixed with the carrier gas. This mixing is further enhanced, as described in our copending patent application Ser. No. 395,627 when the additive gas is introduced into the stream at a location slightly downstream of the upstream end of a tapering region terminating downstream at the restriction before the stream is accelerated.

In addition this invention proposes the step of imparting rotation to the stream and particles at the location. To this end the additive gas is introduced tangentially to impart rotation to the stream, so that the particles are made to move in a helix after they pass the injection location. This helical motion ensures excellent wetting of the particles with the modest amount of liquid according to this invention.

In accordance with another feature of this invention control means monitors the feed rates for the particles and liquid so that the liquid carried by the additive gas and the particles are at a fixed mass ratio with each other. Such control means will not allow the machine to operate unless the particles will be sufficiently wetted.

The apparatus according to this invention has a nozzle conduit having a relatively large upstream end and a downstream end forming a restriction, means for passing a stream of a suspension of a carrier gas and solid particles through the conduit from the upstream to the downstream end and over the restriction so that the stream is accelerated at the restriction, and means for introducing a liquid-carrying additive gas into the stream at a pressure greater than that of the stream at the location. As mentioned above the liquid-carrying additive-gas stream is introduced nonradially slightly downstream of the upstream end of the tapering region terminating downstream at the restriction to impart helical movement to the particles and coat these particles thoroughly.

DESCRIPTION OF THE DRAWING

The above and other features and advantages will become more readily apparent from the following, reference being made to the accompanying drawing whose sole FIGURE is a largely schematic view of the apparatus for carrying out the method of this invention.

SPECIFIC DESCRIPTION

As seen in the drawing a stream 2 of fine sand coated with a hydrophilic wetting agent and suspended in air at a pressure of about 10 bar is fed from a supply 11 through a feed conduit 1 toward a nozzle 3 in a direction 4. This nozzle 3 has a main frustoconically tapered region 5 centered on an axis A and terminating at this extreme downstream end at a restriction 7. Downstream of this restriction 7 the nozzle 3 flares slightly at 6 and then usually opens to the outside. In use the nozzle 3 is directed axially in the direction 4 at the surface to be sand blasted and the sand, as it strikes this surface, strips everything loose or soft from it, abrading and eroding it.

In order to hold down the generation of dust in such an operation the nozzle is fitted with a collar 12 forming a chamber 10 around the upstream portion of the tapered region 5. This chamber 10 opens via a plurality of holes 8 into the nozzle 5 at a location about one-fourth of the way between the upstream end of the tapered region 5 and the restriction 7. The holes 8 are directed generally tangentially to impart rotation to the stream and at an angle of about 45° to the axis A.

A suspension 13 of water in air is fed from a supply 14 through a conduit 9 to the chamber 10 at a pressure of about 20 bar. As a result of this pressure the suspension 13 mixes thoroughly with the suspension 2. The sand carried in the suspension 2 is thoroughly wetted, so that when it is expelled from the end 6 it will not create considerable dust.

A controller 15 is connected to the supply 14 for the air/$H_2O$ suspension and to a valve 16 controlling the intake of sand and wetting agent, so that the above-defined 4% mass ratio between water and sand is maintained. Since a serious safety hazard is proposed when the system operates with too dry a mix, this controller 15 shuts the machine down when the feed of solids is excessive or the feed of water is inadequate.

Thus the system according to the instant invention automatically ensures slight wetting of each and every particle of sand so that very little dust will be generated by the sand-blasting operation. At the same time the addition of water is limited so that there will be no wet runoff.

We claim:

1. In a method of sand blasting wherein a stream of a suspension of a carrier gas and solid particles at superatmospheric pressure is progressively restricted in a tapering region of a conduit so that it is accelerated; and a liquid-carrying additive gas is introduced into said stream at a location generally at the upstream end of the region and mixed with said stream to moisten said particles, the improvement wherein said additive gas is introduced into said stream at a pressure greater than the pressure of said stream at said location by between 1.5 and 2.5 times, said additive gas is introduced into said stream in a unit of time at a rate sufficient to introduce into said stream a quantity of the liquid equal to between about one-twentieth to one-thirtieth the mass of the particles passing said location during said unit of time, and in another unit of time the mass of the particles of the carrier-gas stream passing the mixing location is equal to between about 1.4 to 2.5 times the mass of the carrier gas passing said location during said other unit of time.

2. The improvement in sand blasting defined in claim 1, further comprising the step of coating said particles with a hydrophilic agent before suspending said particles in said stream.

3. The improvement in sand blasting defined in claim 1 wherein the pressure of said additive gas is between 10 bar and 30 bar.

4. The improvement defined in claim 3 wherein said location is immediately downstream of the upstream end of said region.

5. The improvement in sand blasting defined in claim 4, further comprising the step of imparting rotation to said stream and particles at said location.

6. The improvement in sand blasting defined in claim 5 wherein said additive gas is introduced tangentially to impart rotation to said stream.

7. The improvement in sand blasting defined in claim 5 wherein said additive gas and said particles are at a fixed mass ratio with each other.

* * * * *